US009761093B2

(12) United States Patent
Kucala

(10) Patent No.: US 9,761,093 B2
(45) Date of Patent: Sep. 12, 2017

(54) DUAL STROBE EXPANDER PLATE

(75) Inventor: Thomas J. Kucala, Cortland, IL (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 695 days.

(21) Appl. No.: 13/230,008

(22) Filed: Sep. 12, 2011

(65) Prior Publication Data

US 2013/0063275 A1 Mar. 14, 2013

(51) Int. Cl.
*G08B 5/00* (2006.01)
*G08B 5/36* (2006.01)
*G08B 5/38* (2006.01)

(52) U.S. Cl.
CPC *G08B 5/36* (2013.01); *G08B 5/38* (2013.01)

(58) Field of Classification Search
CPC . G08B 5/36; G08B 5/38; G08B 17/10; G08B 3/10; G08B 7/06
USPC ..... 340/815.4, 693.9, 693.12; 361/679; 439/140, 527, 172, 607.55, 607.44, 439/607.28, 607.27
See application file for complete search history.

(56) References Cited

U.S. PATENT DOCUMENTS 5,805,071 A * 9/1998 Hur ..... 340/693.9
6,127,935 A * 10/2000 Davidson et al. ..... 340/691.5
6,313,744 B1 11/2001 Capowski et al.
6,426,697 B1 7/2002 Capowski et al.
6,462,665 B1 10/2002 Tarlton et al.
6,693,532 B2 2/2004 Capowski et al.
6,838,997 B1 * 1/2005 Davidson ..... 340/693.9
7,006,003 B2 2/2006 Zimmerman et al.
7,091,847 B2 8/2006 Capowski et al.
7,145,466 B2 12/2006 Haynes et al.
7,333,010 B2 2/2008 Barrieau et al.
7,358,855 B1 4/2008 Willis
7,382,245 B2 6/2008 Girouard
7,636,049 B2 12/2009 Ellul, Jr.
7,663,500 B2 2/2010 Curran et al.
7,791,496 B2 * 9/2010 Anderson et al. ..... 340/691.1
7,920,053 B2 * 4/2011 Pattok et al. ..... 340/331
8,511,630 B2 * 8/2013 Varieur ..... 248/300
2002/0075473 A1 * 6/2002 Davidson et al. ..... 356/4.01
2005/0073426 A1 * 4/2005 Hines ..... 340/691.1
2005/0229452 A1 10/2005 Shimasaki
2007/0242460 A1 10/2007 Nagarajan
2009/0072989 A1 3/2009 Rock et al.
(Continued)

FOREIGN PATENT DOCUMENTS

GB 2 372 556 A 8/2002
WO WO 2005/069238 A1 7/2005

OTHER PUBLICATIONS

Tyco Safety Products; TrueAlert addressable Notification Applicences "Simplex"; Mar. 2011; pp. 1-4; S4906-0009-1; Westminster, MA, 01441-0001 USA.
(Continued)

*Primary Examiner* — John A Tweel, Jr.
(74) *Attorney, Agent, or Firm* — Husch Blackwell LLP

(57) ABSTRACT

An output device mounting plate can, in a disclosed embodiment, carry a fixedly mounted strobe unit and a displaced region to releasably attach additional output devices. The additional output devices can include a verbal output device, an audible output device, a visual output device, or an audible/visual output device.

13 Claims, 5 Drawing Sheets

(56) References Cited

U.S. PATENT DOCUMENTS

| | | | |
|---|---|---|---|
| 2009/0309740 | A1 | 12/2009 | Savage, Jr. |
| 2010/0033319 | A1 | 2/2010 | Pattok et al. |

OTHER PUBLICATIONS

Telcom & Data, Inc.; Cooper Wheelock Selectable Strobe, Wall Mount, 24VDC, 15/30/75/110 Strobe, Model RSSP-24MCW-FR; On/Before Jan. 15, 2011; pp. 1; Milwaukee, WI 53207, USA.
General Electric; Genesis Strobe Expander, G4E Series; 2009; pp. 4; Data Sheet 85001-0610, Issue 2; USA, Phone 888-378-2329.

* cited by examiner

DUAL STROBE EXPANDER PLATE

FIELD

The application pertains to mounting elements usable with alarm indicating output devices. More particularly, the application pertains to such elements that can support a variable plurality of such output devices.

BACKGROUND

Regional monitoring systems, such as such fire alarm or regional security systems, often include various types of alarm indicating output devices. These include audible or visual devices. Some of these types of devices are mandated by governmental codes. Others respond to customer or installation needs.

Customer or installation needs can be best addressed by providing flexible mounting systems that can meet current known needs and can address future changing needs for types or combinations of output devices.

DETAILED DESCRIPTION

Figure 1:
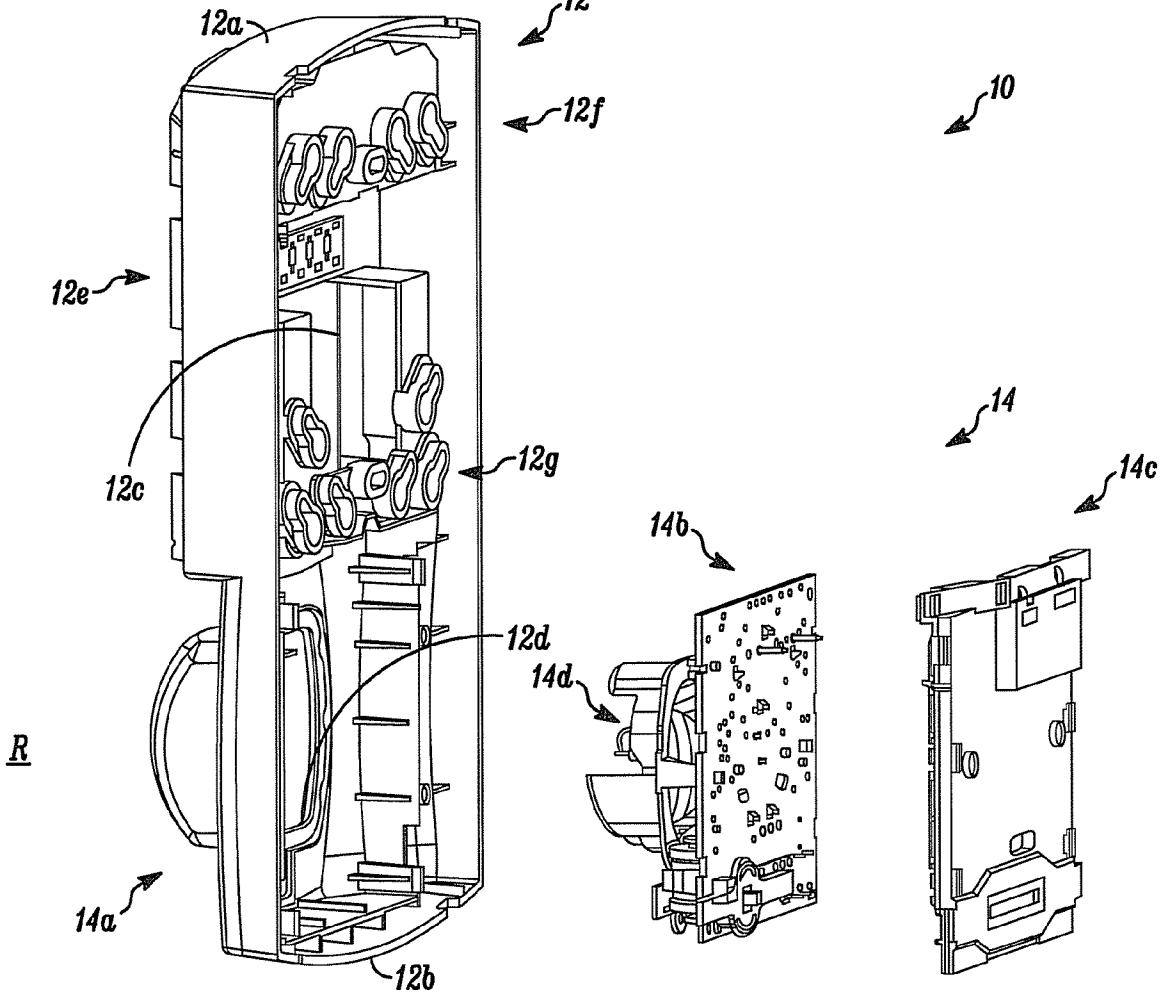
FIG. 1 is an exploded view illustrating aspects of a mounting element in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

Figure 4:
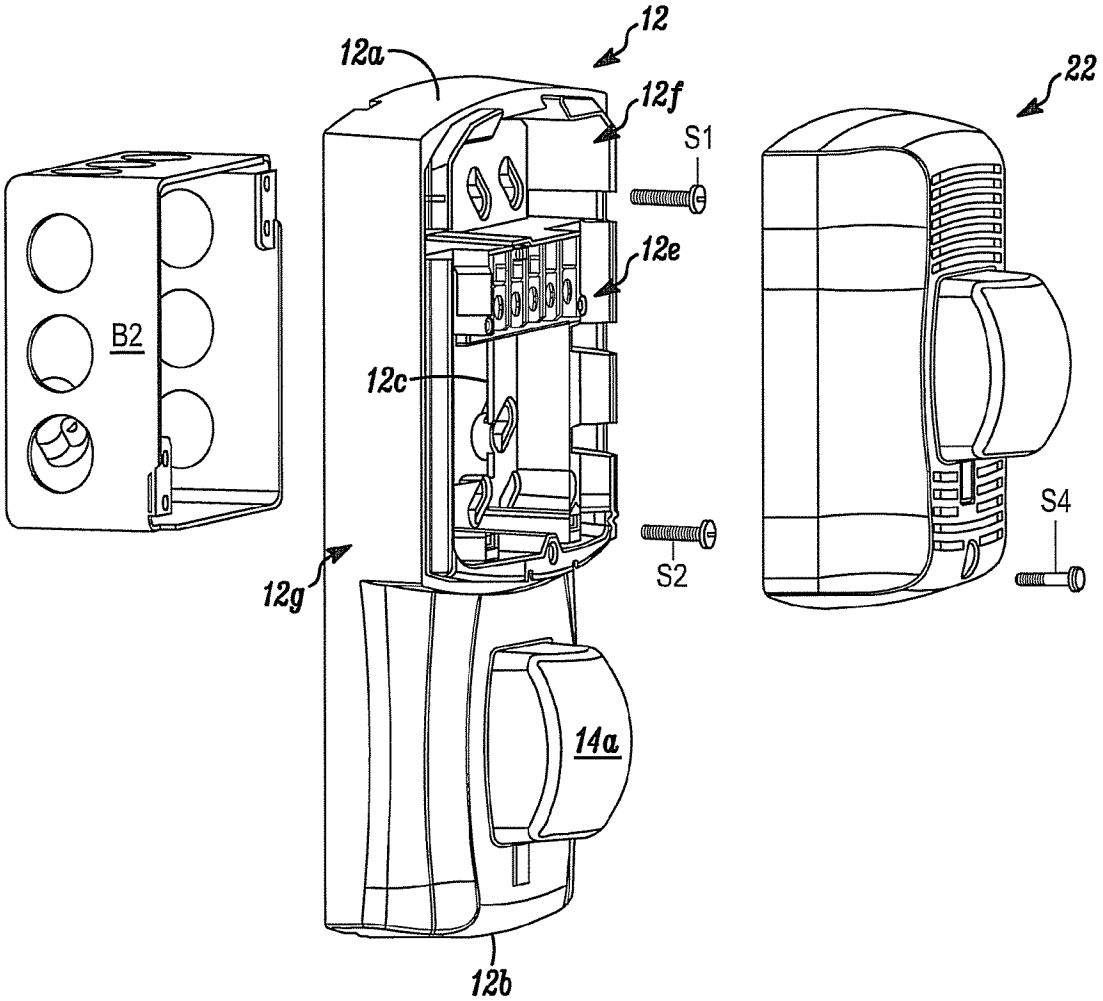
FIG. 4 is an exploded view illustrating installation of a different device combination.

FIG. 1 illustrates an apparatus 10 having a multiple output device elongated mounting plate 12 and carrying a fixedly attached strobe unit 14. The plate 12 is mountable on or in close proximity to an electrical box as best seen in FIG. 4. The plate 12 is elongated with first and second ends 12*a*, 12*b*. The plate 12 defines an upper opening 12*c* and a lower opening 12*d*.

Figure 2A:
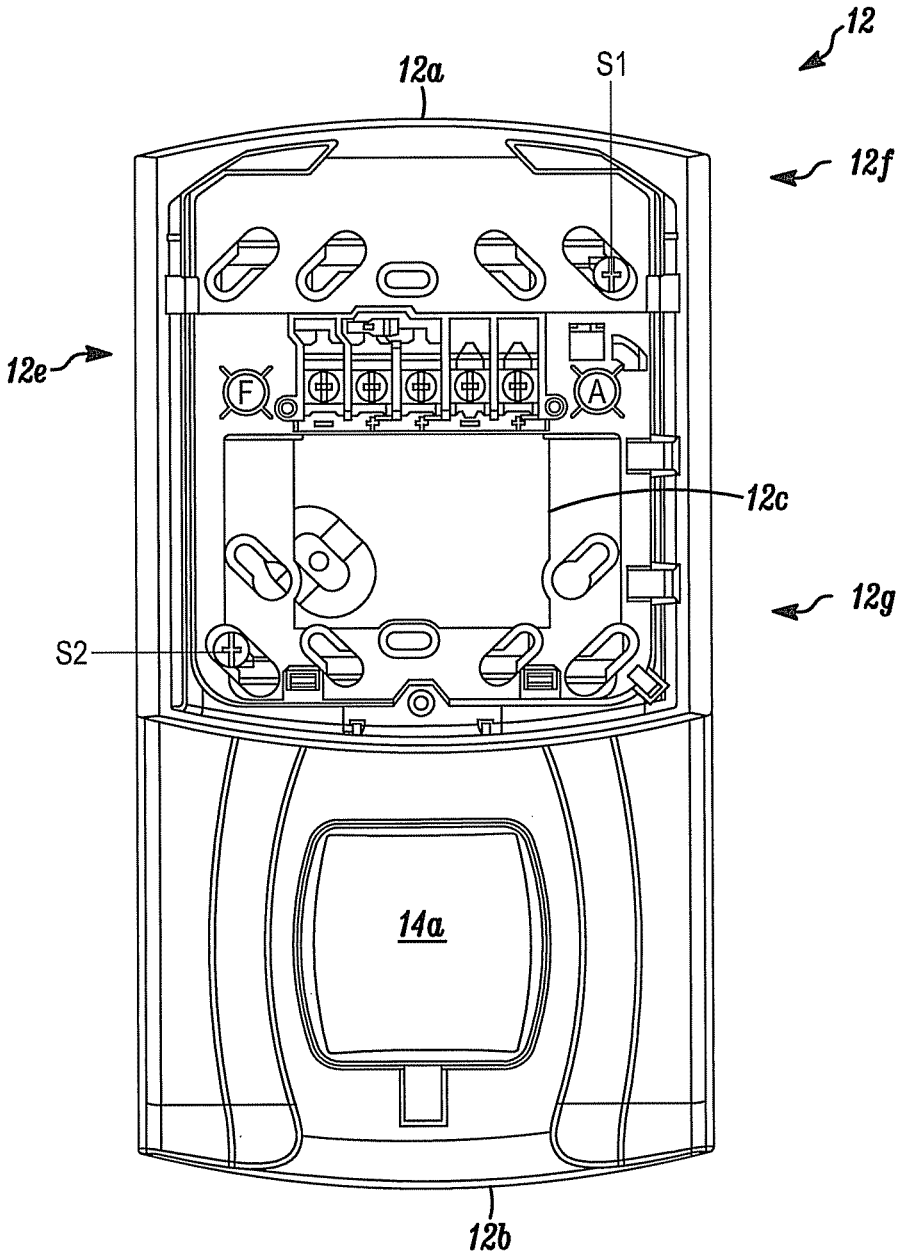
FIG. 2A is a front view of a mounting element as in FIG. 1.
Figure 3:
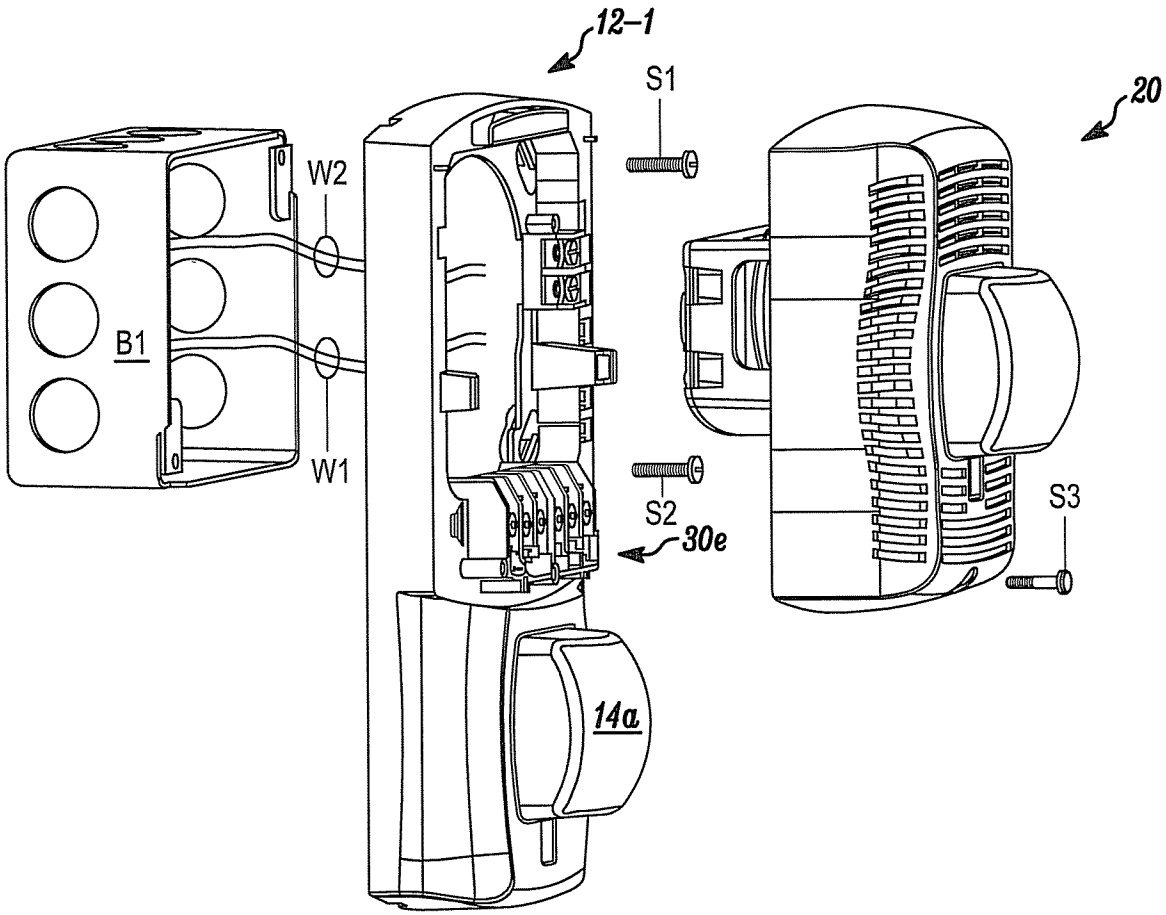
FIG. 3 is an exploded view illustrating installation of one output device combination.

The plate 12 includes a plurality of electrical connectors 12*e* as best seen in FIG. 2A and FIG. 4. Electrical wiring coupled to an associated alarm system extends into the associated electrical box as best seen in FIG. 3 with pairs W1, W2. The wires can be connected to selected ones of the connectors 12*e* to energize the output units carried by the plate 12. As those of skill in the art will understand, the electrical signals coupled to the connectors 12*e* can be modulated to convey commands, addresses, or the like.

Mechanical attachment features 12*f*, 12*g* carried on the plate 12 can receive screws or other fasteners, such as S1 and S2, to attach the plate 12 to the respective electrical box, such as B1 or B2. Also, as best seen in FIGS. 3 and 4, the attachment plates, such as the plate 12, are longer than the respective electrical boxes B1, B2 to be able to carry multiple output devices.

The device 14, illustrated for exemplary purposes as a strobe, has a lens 14*a* attached to the respective plate, such as the plate 12, a body portion that carries the electronics and flash tube module 14*b*, and a backplate 14*c*. As illustrated in FIG. 1, the electronics and flash tube module 14*b* is sandwiched between the lens 14*a* and the backplate 14*c*. The backplate 14*c* is coupled to the plate 12 with a friction or snap fit. Adhesive or ultrasonic welding can also be used. It will also be understood that in an alternate embodiment, the strobe 14 could also be field installable and changeable.

Electrical conductors extend between selected ones of the connectors 12*e* and the module 14*b* to energize and flash the associated flash tube 14*d*. The strobe unit 14 and the lens 14*a* can be used to indicate an alert condition, for example, that a region R being monitored by the associated monitoring system should be evacuated. Hence, the lens 14*a* can be of a selected alert indicating color that is not one associated with a fire condition, for example.

Members 20, 22 of a plurality of alarm indicating output devices as best seen in FIGS. 3 and 4 can indicate a predetermined condition and can be removably coupled to the illustrated mounting plates 12, 12-1. The members 20, 22 can be selected from a class that includes at least verbal output devices, audible output devices, visual output devices, or audio/visual output devices, all without limitation.

The members 20, 22 have a form-factor, including electrical connectors that slidably engage respective portions of the appropriate mounting plate 12, 12-1. It will be understood that none of the exact details of the output devices 20, 22 are limitations hereof other than as set forth herein. Hence, as the interchangeable output devices are mounted on the respective mounting plate 12, 12-1, they slidably engage respective ones of the connectors 12*e* to be able to receive electrical energy therefrom when connected with the pairs of wires in the box, such as B1 and B2. The respective output devices can be attached to the respective plate 12, 12-1 by a fastener, such as screws S3, S4. It will also be understood the output devices 20, 22 are field installable and could be replaced or changed after initial installation unlike the fixedly mounted units 14.

Figure 2B:
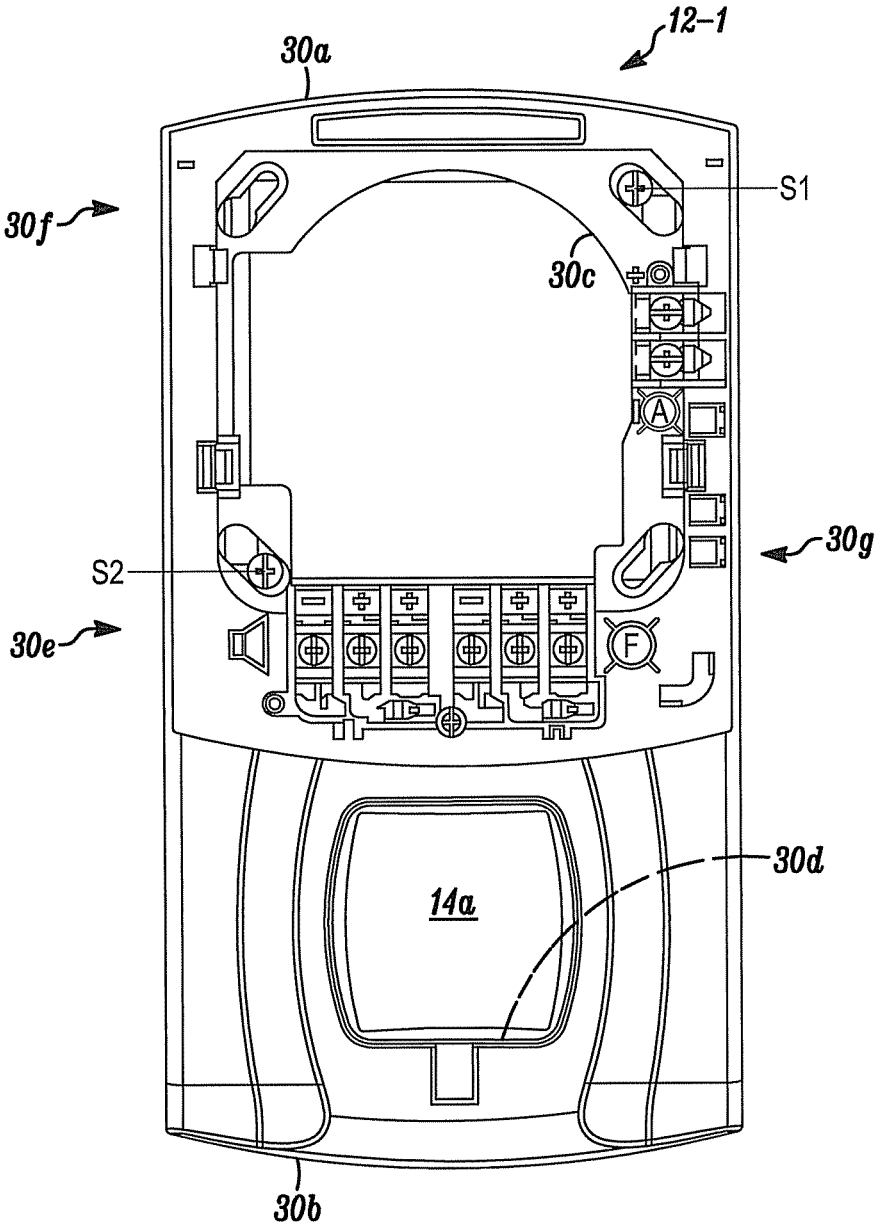
FIG. 2B is a front view of a different mounting element.

FIGS. 2B and 3 illustrate an alternate form of a multiple output device elongated mounting plate 12-1 that also carries a fixedly attached strobe unit 14. The plate 12-1 is mountable on or in close proximity to an electrical box as best seen in FIG. 3. The plate 12-1 is elongated with first and second ends 30*a*, 30*b*. The plate 12-1 defines an upper opening 30*c* and a lower opening 30*d*.

The plate 12-1 includes a plurality of electrical connectors 30*e* as best seen in FIG. 2B and FIG. 3. Electrical wiring coupled to an associated alarm system extends into the associated electrical box as best seen in FIG. 3 with the pairs W1, W2. The wires can be connected to selected ones of the connectors 30*e* to energize the output units carried by the plate 12-1. As those of skill in the art will understand, the electrical signals coupled to the connectors 30*e* can be modulated to convey commands, addresses, or the like.

Mechanical attachment features 30*f*, 30*g* carried on the plate 12-1 can receive the screws or other fasteners, such as S1 and S2, to attach the plate 12-1 to the respective electrical box, such as B1 or B2. Also, as best seen in FIGS. 3 and 4, the attachment plates, such as the plate 12-1, are longer than the respective electrical boxes B1, B2 to be able to carry multiple output devices.

Other variations come within the spirit and scope hereof. For example, where the boxes, such as B1 and B2, are surface mounted, a back box skirt can be interposed between the wall and the respective expander or mounting plate, such as 12 and 12-1.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to or removed from the described embodiments.

The invention claimed is:

1. An apparatus comprising:

an elongated mounting plate, wherein the elongated mounting plate includes first and second ends;

a first plurality of electrical connectors carried by the elongated mounting plate proximate the second end and engagable with a source of electrical energy; and a plurality of output devices carried by the elongated mounting plate, wherein a first of the plurality of output devices includes a strobe unit fixedly coupled to and carried by the elongated mounting plate proximate the first end of the elongated mounting plate, wherein electrical conductors extend between first ones of the first plurality of electrical connectors proximate the second end and the first of the plurality of output devices proximate the first end to provide energy to the first of the plurality of output devices proximate the first end, wherein a second of the plurality of output devices includes a removably coupled output device attachable to the elongated mounting plate proximate the second end of the elongated mounting plate, and wherein the second of the plurality of output devices proximate the second end slidably engages second ones of the first plurality of electrical connectors proximate the second end to provide the energy to the second of the plurality of output devices proximate the second end.

2. An apparatus as in claim 1 wherein the removably coupled output device is part of a plurality of different attachable modules, and wherein each of the plurality of different attachable modules indicates a respective predetermined condition.

3. An apparatus as in claim 2 wherein each of the plurality of different attachable modules carries a second plurality of electrical connectors for slidably engaging the second ones of the first plurality of electrical connectors when a respective one of the plurality of different attachable modules is installed proximate the second end of the elongated mounting plate.

4. An apparatus as in claim 3 wherein members of the plurality of different attachable modules are selected from a class that includes a verbal output module, an audio output module, a visual output module, and an audible/visual output module.

5. An apparatus as in claim 3 wherein each of the plurality of different attachable modules carries an attachment element for mechanically attaching the respective one of the plurality of different attachable modules to the elongated mounting plate.

6. An apparatus as in claim 3 wherein the second end includes an interior open region.

7. An apparatus as in claim 1 wherein the elongated mounting plate includes an electrical box attachment structure.

8. An apparatus as in claim 7 wherein the elongated mounting plate extends from a respective electrical box in an elongated direction.

9. A mounting plate comprising:

an elongated body defining first and second spaced apart openings therethrough for carrying first and second output devices in respective ones of the first and second spaced apart openings proximate respective ones of first and second sides of the elongated body;

electrical connectors carried on the elongated body within the second spaced apart opening;

at least one attachment element carried on the elongated body within the first spaced apart opening; and a different attachment element carried on the elongated body within the second spaced apart opening, wherein electrical conductors extend between at least one of the electrical connectors carried within the second spaced apart opening and the first output device coupled to the at least one attachment element carried within the first spaced apart opening, and wherein at least a different of the electrical connectors carried within the second spaced apart opening is slidably engagable with the second output device coupled to the different attachment element carried within the second spaced apart opening.

10. A mounting plate as in claim 9 wherein one of the first and second spaced apart openings is closed with a lens.

11. A mounting plate as in claim 10 wherein a strobe unit is mounted behind the lens.

12. A mounting plate as in claim 11 wherein a backplate is attached to the at least one attachment element and extends along a substantially planar side of the strobe unit, and wherein the strobe unit is sandwiched between the backplate and the lens.

13. A mounting plate as in claim 12 wherein the at least one attachment element includes adhesive, a snap fit, or a friction fit.

* * * * *